United States Patent [19]

Bogorad et al.

[11] 4,146,133

[45] Mar. 27, 1979

[54] STERILE, HEAT SEALABLE PLASTIC BAG

[75] Inventors: Samuel Bogorad; Conrad Goldman, both of Rochester, N.Y.

[73] Assignee: Surgicot, Inc., Hempstead, N.Y.

[21] Appl. No.: 735,058

[22] Filed: Oct. 22, 1976

[51] Int. Cl.[2] ..... B65D 27/32; B65D 31/12

[52] U.S. Cl. ..... 206/439; 206/632; 206/633; 229/56; 229/DIG. 3

[58] Field of Search ..... 229/66, DIG. 3, 48 R, 229/56, 53; 206/439, 440, 441, 438, 63.3, 63.5, 632, 633

[56] References Cited

U.S. PATENT DOCUMENTS

| | | | |
|---|---|---|---|
| 2,668,769 | 2/1954 | Schlienz | 229/48 T |
| 2,842,179 | 7/1958 | Hoeppner | 229/53 |
| 2,897,961 | 8/1959 | Bush | 206/441 |
| 3,017,990 | 1/1962 | Singerman | 206/440 |
| 3,419,136 | 12/1968 | Pratt | 229/66 X |
| 3,754,700 | 8/1973 | Bonk | 206/439 X |
| 3,851,814 | 12/1974 | Stage | 229/53 |

*Primary Examiner*—Stephen P. Garbe
*Attorney, Agent, or Firm*—Bauer & Amer

[57] ABSTRACT

A heat sealable plastic bag for retaining articles in a sterile atmosphere and which includes gussets and a flap in a remote location such that when the bag is opened by pulling open the flap, the bag opening and its contents are protected by the flap from contaminating contact with the flap exterior and/or the user to insure a continued completely sterile atmosphere for the bag opening and its contents.

12 Claims, 14 Drawing Figures

STERILE, HEAT SEALABLE PLASTIC BAG

BACKGROUND OF THE INVENTION

1. Field of the Invention

This invention relates generally to packages and more particularly, to an improved sterile heat sealable plastic gusseted bag having a readily openable sterile protective flap.

2. Description of the Prior Art

Thermoplastic bags made of a heat sealable material such as polyethylene are well known in the art and can be made air-tight with inwardly folded longitudinal edges. There are many applications for such bags such as, for example, for the containment of sterilized articles that may be used in the operating room of a hospital. It is necessary that the bag be capable of receiving relatively bulky articles and for this reason, one or more gussets are provided. It is highly desirable that the bag be sterilizable. Of particular importance is the need for means for rapidly opening the bag. It will be readily apparent that under the conditions that prevail in the operating room of a hospital, the time lost in breaking the seal and opening a package containing a surgical instrument can be deleterious to the patient. Moreover, if the package is difficult to open, it is quite possible that, due to fumbling, the contents of the package will be dropped and the sterility thereof will be destroyed. Further, if the bag opening or its contents come into contact with any unsterile portion of the bag or user, it too becomes contaminated and the benefits of sterilization are lost.

Examples of the prior art in the general field to which the present invention is directed are described and illustrated in U.S. Pat. Nos. 3,827,341 and 3,851,814. The structure shown in the aforementioned issued U.S. patents provides a novel container for sterilizable articles. However, one feature that was overlooked in the development of the structure shown in the aforementioned patent is the need for simple, yet effective, closure means that may be readily opened merely by gripping and pulling open the bag while protecting the contents against contaminating contact with the user and/or the exterior surfaces of the bag.

SUMMARY OF THE INVENTION

The present invention meet the needs that have been long recognized in the field and provides a readily openable gusseted package that may be made from a heat sealable material and which may be readily sterilized. In one aspect of the present invention, a portion of a flap is secured, such as by heat sealing or the like, to a remote location of the outside surface of one of the two side walls of the bag. One or both of the two opposed, longitudinally extending sides of the bag may be in the form of gussets with one of the gussets being integral with the flap and with the other gusset being unsealed so that the bag may be loaded. If desired, the side wall to which the flap is secured may extend past the unsealed gusset so as to facilitate the loading of the bag.

In another aspect of the present invention, only a single gusset is provided. Along the opposite longitudinal edge an elongated strip that provides the function of a gusset is secured to one of the side panels of the bag with the other end of the strip being adjacent to the other side panel of the bag and initially unsealed so that the bag may be loaded. In addition, and in combination with the aforementioned strip, an insert may be provided with a portion of the insert being secured, such as by heat sealing or the like, to one of the side panels of the bag and with the outer edge of the insert being left unsealed. The insert, in combination with the side wall of the bag to which it is secured, defines a pocket that may be formed by the ultimate user when the strip and the insert are sealed to the side walls of the bag.

Accordingly, it is an object of the present invention to provide an improved, heat sealable and sterilizable plastic bag.

Another object of the present invention is to provide an improved, plastic bag as described above, wherein means are included for readily opening the bag without resorting to the cutting thereof.

A further object of the present invention is to provide an improved heat sealable plastic bag, as described above, wherein at least one gusset is included.

Yet another object of the present invention is to provide an improved heat sealable bag, as described above, having two opposed, longitudinally extending gussets.

Yet another object of the present invention is to provide an improved, heat sealable plastic bag, as described above, wherein a separate pocket, in addition to the pouch-like interior of the bag, is formed.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings.

BRIEF DESCRIPTION OF THE DRAWINGS

In the drawings, wherein the same reference numerals denote the same element throughout the several views:

FIG. 7 is a plan view of another embodiment of the bag comprising the present invention;

FIG. 8 is a transverse sectional elevational view taken along line 8—8 of FIG. 7;

FIG. 9 is a plan view of a modification of the bag shown in FIG. 7;

FIG. 10 is a transverse sectional elevational view taken along line 10—10 of FIG. 9;

FIG. 11 is a plan view of still another modification of the bag shown in FIG. 7;

FIG. 12 is a transverse sectional elevational view taken along line 12—12 of FIG. 11;

FIG. 13 is a plan view of a further modification of the foregoing embodiments of the present invention; and FIG. 14 is a transverse sectional elevational view taken along line 14—14 of FIG. 13.

DETAILED DESCRIPTION OF THE INVENTION

Figure 1:
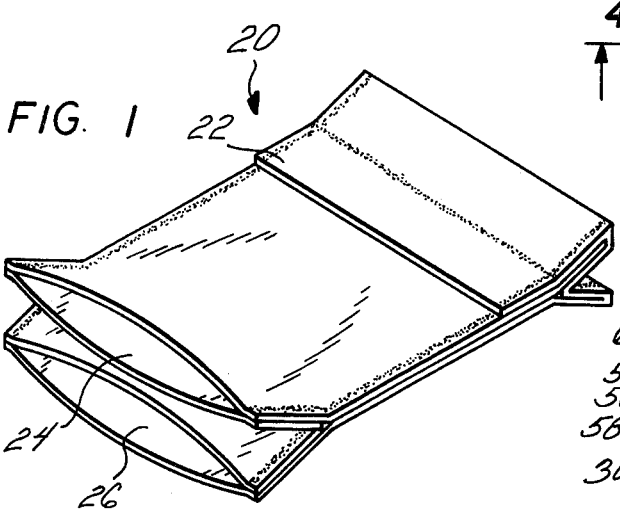
FIG. 1 is a fragmentary, pictorial view illustrating one embodiment of the bag comprising the present invention with the mouth thereof open so as to illustrate both the pouch portion and the pocket portion thereof as well as the tearable flap means that permit the rapid sterile opening of the bag without resorting to cutting.

FIG. 1 is intended to illustrate the method by which the bag 20 comprising the present invention may be utilized. One feature of the bag 20 is the provision of a sterile flap 22 which is heat sealed or otherwise suitably secured to the outside surface of one of the side walls. The bag 20 may be opened by pulling the flap 22 away from the side wall to which it is sealed so that the contents of the bag 20 may be removed sterile and free of contaminating contact with the outer surfaces of the bag and/or the user who must pull the flap 22 in a direction that is away from touching or contact with the contents of the bag. Another feature of the present invention, which is illustrated in FIG. 1, is the provision of a relatively large mouth 24 through which the bag 20 may be loaded prior to the sealing thereof. In an alternative embodiment of the present invention, a second mouth 26 provides entry to a relatively small pocket that is formed along one of the longitudinal sides of the bag 20. These features will be described in more detail hereinafter in conjunction with specific embodiments of the present invention.

Figure 2:
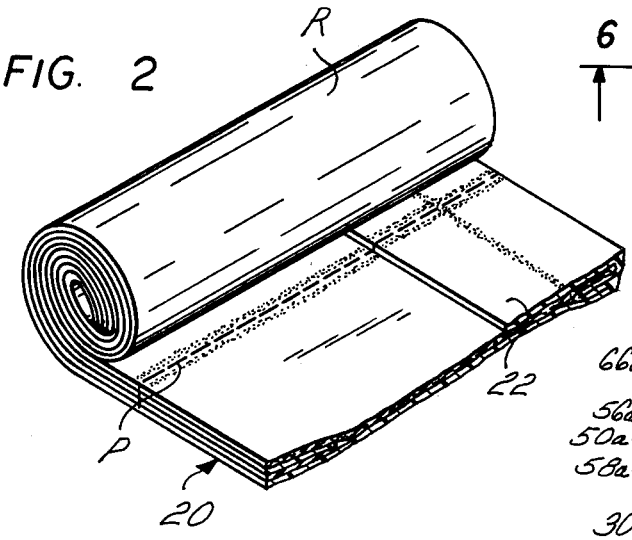
FIG. 2 is a fragmentary pictorial view illustrating a plurality of the bags comprising the present invention coiled on a roll.

As shown in FIG. 2, a plurality of the bags 20 may be supplied on a roll R and may be individually dispensed therefrom by tearing along a line of perforations P. Alternatively, individual ones of the bags 20 may be supplied in a stack.

Figure 3:
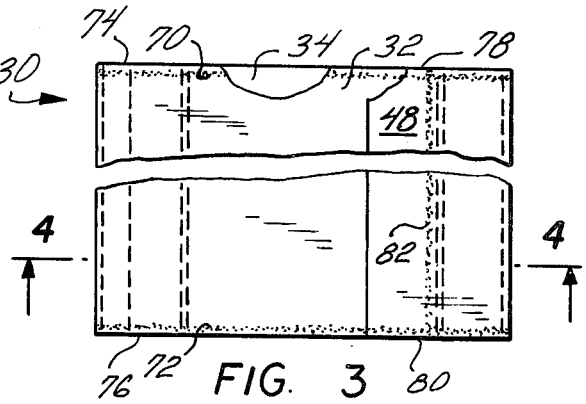
FIG. 3 is a plan view of one embodiment of the bag comprising the present invention.
Figure 4:
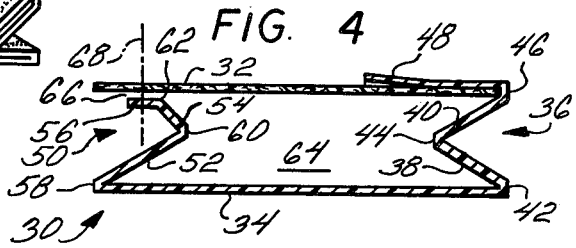
FIG. 4 is a transverse sectional elevational view taken along line 4—4 of FIG. 3.

Referring now to FIGS. 3 and 4, there is shown a first embodiment of the present invention. The bag 30 shown in FIGS. 3 and 4 is comprised of first and second panels 32 and 34 that define the side walls thereof. The panel 32 may be made from a treated heat sealable paper, or a non-woven heat sealable material, such as the type manufactured under the trade name of Tyvek. A first gusset 36 which is defined by sections 38 and 40, is formed integrally with the second panel 34 with bend or fold lines 42, 44 and 46 being provided. A flap 48 is formed remote integrally with the gusset 36 and overlays the panel 32 with the bend or fold line 46 being located between the second section 40 of the gusset 36 and the flap 48.

Along the opposite longitudinal edge of the bag 30 a second gusset 50 is provided. The gusset 50 includes sections 52 and 54 as well as a marginal edge portion 56. Fold lines 58, 60 and 62 are formed as shown in FIG. 4.

It will be appreciated that the first and second panels 32 and 34 together with the gussets 36 and 50 define a pouch 64 for receiving sterile or sterilizable articles. The bag 30 is manufactured with the marginal edge 56 of the gusset 50 being unsealed so as to define a mouth 66 that provides entry to the pouch 64. To facilitate loading of the pouch 64, the marginal edge 56 of the gusset 50 is sealed in any suitable manner to the first panel 32, inwardly of the longitudinal edge thereof, and for example, along the dot and dash line 68 shown in FIG. 4.

In a manner well known in the art, first and second seal means 70 and 72 are utilized for securing the end edges 74 and 76 to each other. The first and second seal means 70 and 72 may be provided by a pair of opposed, heated platens or by adhesives. In addition, the end edges 78 and 80 of the flap 48 are also sealed at the same time as the end edges 74 and 76 so that the central portion of the flap 48 is free. The central portion of the flap 48 is also secured to the outside surface of the first panel 32 by any suitable means such as a heated roller, adhesives or the like, along the line 82 shown in FIG. 3. Thus, to open the bag 30, the free end of the panel 48 is gripped by hand and pulled away from the first panel 32 in order to break the seal 82. It will be noted that the gusset 36 is not sealed to the first panel 32 along the fold or bend line 46.

Figure 5:
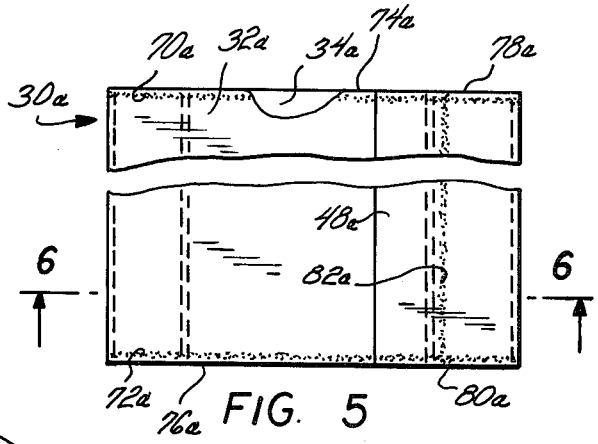
FIG. 5 is a plan view illustrating a modification of the bag shown in FIG. 3.
Figure 6:
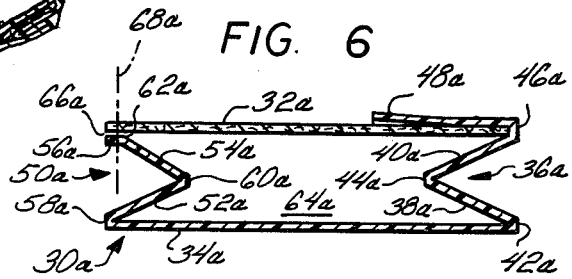
FIG. 6 is a transverse sectional elevational view taken along line 6—6 of FIG. 5.

A modification of the embodiment shown in FIGS. 3 and 4 is illustrated in FIGS. 5 and 6. Since the structure of the modification is substantially identical to that described in connection with the first embodiment shown in FIGS. 3 and 4, the subscript a is used on all reference characters. In the modification of FIGS. 5 and 6, the line 68*a* along which the marginal edge 56*a* of the second gusset 50*a* is secured to the first panel 32*a* is closer to the longitudinal edge of the first panel 32*a*. While mouth 66*a* is still formed in the modification shown for example in FIG. 6, the longitudinal edge of the marginal portion 56*a* is substantially coincidental with the longitudinal edge of the first panel 32*a*.

Turning now to FIGS. 7 and 8, there is shown an alternative embodiment of the present invention. Where the structure is the same as that described in connection with the first embodiment and in connection with the modification of the first embodiment, the subscript b will be applied to all reference characters. In the embodiment shown in FIGS. 7 and 8, the second gusset 50 is changed in structure. In its place there is provided a strip 84 having an inner, longitudinally extending marginal edge 86 and an outer longitudinally extending marginal edge 88. The strip 84 and an insert strip 90, are coextensive and folded at an inner longitudinally extending marginal edge 92 to produce an outer longitudinally extending marginal edge 94. It will be appreciated that the strip 84 and insert strip 90 are long enough to serve the same expansible function as the gusset 50 so that the bag 30*b* may contain relatively bulky articles. Entrance to the pouch 64*b* is achieved through the mouth 66*b* that is defined between the marginal edge 88, and the longitudinal edge of the first panel 32*b*. In addition, the combination of the insert strip 90 and the second panel 34*b* defines a pocket 96 having a mouth 98. The inner edges 88 and 94 of the strip 84 and the insert strip 90, respectively, are heat sealed or otherwise suitably secured to the respective panel 32 and panel 34. After the pouch 64*b* and the pocket 96 are filled, the left hand longitudinal edge of the bag 30*b*, as seen in FIG. 8, may be sealed, either by heat, adhesive or any other suitable means along the dot and dash line 100.

A modification of the foregoing embodiment is shown in FIGS. 9 and 10. Since all of the structure is the same, the subscript c will be used for all of the reference characters. It will be noted that the only difference between the modification shown in FIG. 10 and the embodiment shown in FIG. 8 is that the strips 84*c* and 90*c* are secured in any suitable manner to the first panel 32*c*.

FIGS. 11 and 12 represent a modification of the structure shown in FIGS. 9 and 10 and the subscript d will be used to indicate the similarity of the components. In this last mentioned modification, the second panel 34*d* is provided with an extension 102 that is adapted to be folded over the outer surface of the first panel 34*d* and sealed along a line 104. The extension 102 is folded and sealed after the pouch 64*d* and the pocket 96*d* are filled.

FIGS. 13 and 14 represent still another modification of the second embodiment of the present invention. In order to indicate the similarity of components, the subscript e will be used for all common structure. In the modification of FIGS. 13 and 14, a strip 106 and an insert 108 are formed integrally with each other and with the second panel 34*e*. Bend or fold lines 110 and 112 are utilized. After the pouch 64*e* is filled, the bag 30*e* may be sealed in any suitable manner along a line 114. The pocket 96*e* may then be filled after which it too is sealed along a line 116.

It will be appreciated from the foregoing that both of the embodiments, and each of the modifications thereof described hereinabove, include a flap which is initially sealed to one of the side panels of the bag at a location remote from the opening that is produced when the flap is torn open. This assures that the fingers and hand of the user are always covered by the flap and positioned away from the bag contents so as to protect it from contaminating contact with the bag contents. Moreover, by locating the flap on a remote side panel, when the flap is handled and torn open, it too is pulled in a direction away from the bag opening so that even the flap is now completely free of contaminating contact with the bag opening and its contents. This advance in the art insures that whatever contaminants may exist on the outer surfaces of the bag will not be communicated to the bag opening or its contents thereby resulting in a sterilizable bag that is unusually adapted for surgical procedures. In both embodiments and in each modification thereof, a mouth is formed to permit easy loading of the pouch. In one embodiment of the present invention and in several modifications thereof, a separate pocket is also formed. In one embodiment of the present invention, two longitudinally extending gussets are provided while in the second embodiment of the invention, only a single longitudinally extending gusset is formed and the opposite longitudinally extending edge is provided with a strip having the same function as a gusset.

It will be evident from the foregoing that the bag comprising the present invention may be readily formed using conventional and well known structure. The several layers of material comprising the bags may be coiled on supply rolls and fed as desired.

While there have been shown and described and pointed out the fundamental novel features of the invention as applied to preferred embodiments thereof, it will be understood that various omissions and substitutions and changes in the form and details of the device as illustrated and in its operation may be made by those skilled in the art without departing from the spirit of the invention. It is the intention, therefore, to be limited only as indicated by the scope of the claims appended hereto.

What is claimed is:

1. A bag for use in sterilization procedures comprising:

first and second panels defining the side walls of said bag;

first and second seal means for securing the ends of said first and said second panels to each other;

first closure means for closing an adjacent pair of side edges of said first and said second panels;

a flap integral with said first closure means and overlaying said first panel;

third seal means for securing said flap to said overlayed panel such that a hand grippable portion is formed on said flap whereby said third seal means may be broken by pulling on said hand grippable portion to thereby permit access to the interior of said bag;

and second closure means opposite said first closure means secured to one of said two panels inward from the end thereof and separate from the other of said two panels and sealed separately to each of said two panels outward of its securement to said one panel for completely sealing said bag such that said second closure means secures together said first and second panels opposite said first closure means to join said panels together to form a closed pocket between said first and second closure means and a separate closed pocket between said second closure means and said one panel, said first closure means being a gusset integral with and positioned interiorly between said first and second panels.

2. A bag according to claim 1 wherein one of said two panels extends beyond the edge of the other of said two panels and wherein said second closure means is sealed to the other of said panels inwardly of the marginal edge thereof.

3. A bag according to claim 1 wherein said other panel extends beyond the edge of said overlayed panel and is adapted to overlay said overlayed panel after said bag is loaded.

4. A bag according to claim 1 wherein said second closure means is a second gusset.

5. A bag according to claim 4 wherein said second gusset is formed integrally with said panel that is opposed to said overlayed panel.

6. A bag for use in sterilization procedures comprising:

first and second panels defining the side walls of said bag;

first and second seal means for securing the ends of said first and said second panels to each other;

first closure expandible means for closing an adjacent pair of side edges of said first and said second panels;

a flap integral with said first closure means and overlaying one of said two panels;

third seal means for securing said flap to said overlayed panel such that a hand grippable portion is formed on said flap whereby said third seal means may be broken by pulling on said hand grippable portion to thereby permit access to the interior of said bag;

and second closure expandible means formed non-integral with one of said two panels and thereafter secured thereto and sealed to the other of said two panels after said bag is loaded for completely sealing said bag, and said second closure means includes a strip that is secured to said panel that is opposed to said overlayed panel and an insert is positioned intermediate said strip and said opposed panel to which said strip is secured to thereby define a pocket between said insert and opposed panel to be closed by the sealing of said second closure means about said insert.

7. A bag for use in sterilization procedures comprising:

first and second panels defining the side walls of said bag;

first and second seal means for securing the ends of said first and said second panels to each other;

first closure expandible means for closing an adjacent pair of said edges of said first and said second panels;

a flap integral with said first closure means and overlaying one of said two panels;

third seal means for securing said flap to said overlayed panel such that a hand grippable portion is formed on said flap whereby said third seal means may be broken by pulling on said hand grippable portion to thereby permit access to the interior of said bag;

and second closure expandible means formed non-integral with one of said two panels and thereafter secured thereto and sealed to the other of said two panels after said bag is loaded for completely sealing said bag, said second closure means includes a strip secured to said overlayed panel and whereby an insert is positioned intermediate said strip and said overlayed panel to thereby define a pocket between said insert and overlayed panel.

8. A gusseted bag comprising:

first and second panels defining the side walls of said bag;

first and second seal means for securing the end edges of said first and said second panels to each other;

gusset means for closing an adjacent pair of side edges of said first and said second panels;

insert means secured to one of said panels proximate the edge thereof opposite said gusset means to form a pocket between said insert means and said panel; and closure means secured to said one panel and adapted to be sealed to the other said panel and to said insert after said bag and said pocket are loaded.

9. A bag according to claim 8 wherein said gusset means is an extension of one of said panels and includes a flap that is adapted to be folded over and secured to the other of said panels.

10. A bag according to claim 8 wherein said closure means is a strip.

11. A sterile bag for containing a sterile article therein comprising:

first and second walls connected together along at least three sides thereof to form a bag opening along a fourth side through which an article contained therein may be removed therefrom;

and flap means on one of said walls extending in covering relation over said fourth side and being sealed to the outside surface of the other of said walls such that said seal of said flap means is in air-tight sterile relationship with and remote from said bag opening and the article contained in said bag and the facing inside surface of said flap means is prevented from exposure to the exterior of said bag until said seal is torn and said flap means is opened by the hand of the user pulling the same in a direction away from said remote seal to the outside surface of the other of said walls and away from said fourth side such that the hand of the user of the bag is prevented from coming into contaminating contact with the sterile bag opening made at said fourth side by the tearing open of said flap means and the sterile article contained in said bag, at least one of said sides having a pocket sealed separate from said interior space of said bag to provide a sterile pocket in which a sterile article may be contained separate from the article contained in said interior space.

12. A sterile bag as in claim 11, at least one of said sides being gusseted between said first and second walls to enable said walls to move toward and away from each other to vary the interior space of said bag.

* * * * *